US005958330A

United States Patent [19]

Westman

[11] Patent Number: 5,958,330

[45] Date of Patent: Sep. 28, 1999

[54] DOUBLE LEVEL AGING OVEN

[75] Inventor: Kurt H. Westman, Roanoke, Ind.

[73] Assignee: ALFE Systems, Inc., Fort Wayne, Ind.

[21] Appl. No.: 08/960,725

[22] Filed: Oct. 30, 1997

Related U.S. Application Data

[63] Continuation of application No. 08/513,276, Aug. 10, 1995, abandoned.

[51] Int. Cl.[6] ..... C21D 1/06

[52] U.S. Cl. ..... 266/252; 432/128

[58] Field of Search ..... 266/249, 252; 432/121, 128, 250, 242

[56] References Cited

U.S. PATENT DOCUMENTS

| | | | |
|---|---|---|---|
| 1,239,246 | 9/1917 | Allan | 432/128 |
| 3,620,517 | 11/1971 | Keough | 263/6 R |
| 4,030,947 | 6/1977 | Kemper | 148/12.9 |
| 4,154,576 | 5/1979 | Bossetti | 432/128 |
| 4,205,935 | 6/1980 | Edler et al. | 414/152 |
| 4,225,121 | 9/1980 | Meyer et al. | 266/130 |
| 4,579,319 | 4/1986 | Sasaki | 266/252 |
| 4,684,008 | 8/1987 | Hayashi et al. | 198/436 |
| 5,242,156 | 9/1993 | Kay | 266/105 |
| 5,261,527 | 11/1993 | Krismanth et al. | 198/833 |
| 5,398,600 | 3/1995 | Madsen et al. | 99/477 |
| 5,402,994 | 4/1995 | Egger | 266/252 |

*Primary Examiner*—Scott Kastler
*Attorney, Agent, or Firm*—Randall J. Knuth

[57] ABSTRACT

The invention disclosed includes a heat treatment aging oven for heating metal parts having a heating chamber with an opening, a first transport mechanism disposed within the heating chamber for moving a first metal part through the heating chamber, and a second transport mechanism disposed within the heating chamber for moving a second metal part through the heating chamber, the first transport mechanism located in a spaced relationship to the second transport mechanism. A two piece door assembly for selectively opening the oven opening is also disclosed.

8 Claims, 3 Drawing Sheets

DOUBLE LEVEL AGING OVEN

This is a continuation of application Ser. No. 08/513,276, filed Aug. 10, 1995, now abandoned.

BACKGROUND OF THE INVENTION

1. Field of the Invention

The present invention relates to heat treating aging ovens, and particularly those utilized in the heat treating art.

2. Description of the Related Art

Aging of metal parts is accomplished in refractory type ovens which utilize a large amount of factory floor space. By utilization of more than one of these ovens requires extra factory floor space. These ovens are large capital expenditures for manufacturing companies. Since each of these ovens are dedicated to a single product type, normally a plurality of ovens are utilized for heat treating a like plurality of different parts. By having duplicate ovens, the manufacturing companies must incur larger capital outlays for installation, use, and maintenance of the ovens. Additionally, factories having two or more such ovens necessarily require duplicate controls, further increasing the cost of producing heat treated parts.

What is needed in the art is an aging oven able to handle more than one product type at a time, thereby permitting utilization of two different process length times within the same oven.

SUMMARY OF THE INVENTION

The present invention involves an aging oven including two transport or conveyor mechanisms to create a double level heat treating volume within the oven. By utilizing two separate transport conveyor systems, two different heat treating process lengths may be utilized within the same oven to permit heat treating of diverse product types. Heat treating cycle process lengths are dependent upon the density of parts and their geometries, and the required amount of heat necessary for a predetermined part hardness.

In addition, an improved type of door assembly is included for both the entrance and exit of the oven. The door assembly is utilized to open only portions of the oven necessary to feed either of the two transport mechanisms. Two vertically oriented doors contain a lock mechanism therebetween so that only a single drive mechanism is necessary to operate the assembly.

An advantage of the present invention is that by utilizing the two transport mechanisms within the oven, two diverse product types may be heat treated at the same time, thereby saving large quantities of factory floor space.

Another advantage of the present invention is that it eliminates duplicate controls between previously, separate aging ovens. Common forced connection equipment such as recirculating fans and common combustion/heat source equipment are utilized to reduce cost.

A further advantage of the present invention is that up to twice as much material may be passed through the oven as compared to previous utilization of the oven, thereby further increasing manufacturing and cost efficiencies.

Yet another advantage of the present invention is that by utilizing a two door system over the oven entrances and exits the oven retains a greater amount of heat, thereby reducing operating costs.

The invention comprises, in one form thereof, a heat treatment aging oven for heating metal parts. The oven includes a heating chamber having a opening, a first transport means disposed within the heating chamber for moving a first metal part through the heating chamber and a second transport means disposed within the heating chamber for moving a second metal part through the heating chamber, the first transport means located in spaced relationship to the second transport means.

The invention comprises, in another form thereof, a door assembly for an opening of a heat treating oven. The door assembly includes a first door covering a first portion of the oven opening and a second door covering a second portion of the oven opening. A lock mechanism selectively locks the first door and the second door together. A drive mechanism is connected to the first door, and is adapted to move said first door to open the first portion and adapted to move both the first door and the second door to open the second portion, whereby the first portion and the second portion of the heating chamber opening may be selectively and independently opened.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplification set out herein illustrates preferred embodiments of the invention, and such exemplifications are not to be construed as limiting the scope of the invention in any manner.

DETAILED DESCRIPTION OF THE INVENTION

Figure 1:
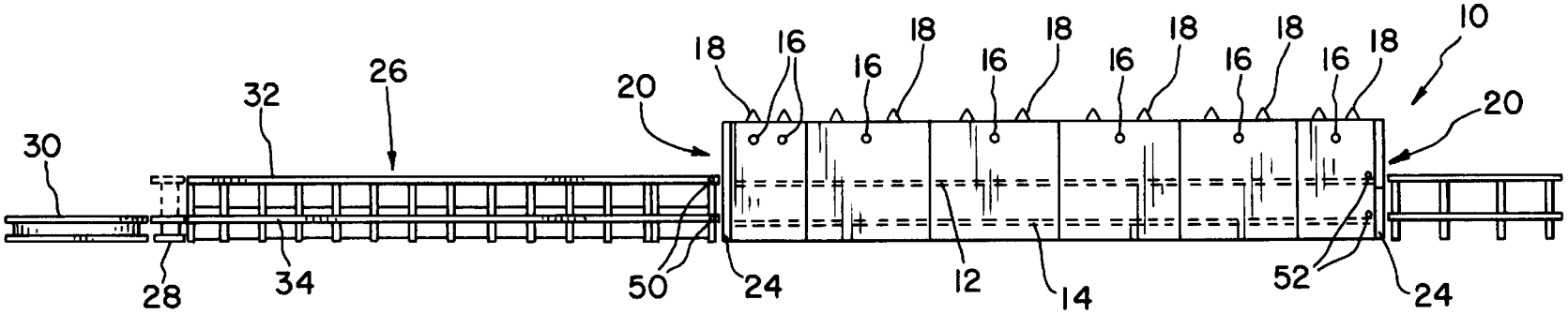
FIG. 1 is an elevational view of an embodiment of the aging oven of the present invention.

Referring now to the drawings and particularly to FIG. 1, there is shown the double level aging oven 10 of one form of the present invention. Oven 10 is a heating chamber therethrough utilizing a first transport means, such as a first rack of rollers 12, oriented as a top rack, while beneath first rollers 12 is a second transport means 14, such as a second rack of rollers 14. Alternatively, other types of structures may be utilized to transport workpieces through the heating chamber of oven 10 such as conveyor belts, rail moving systems, and the like. Also other arraignments of the transport means through the heating chamber may be utilized such as side by side or other orientation.

Figure 2:
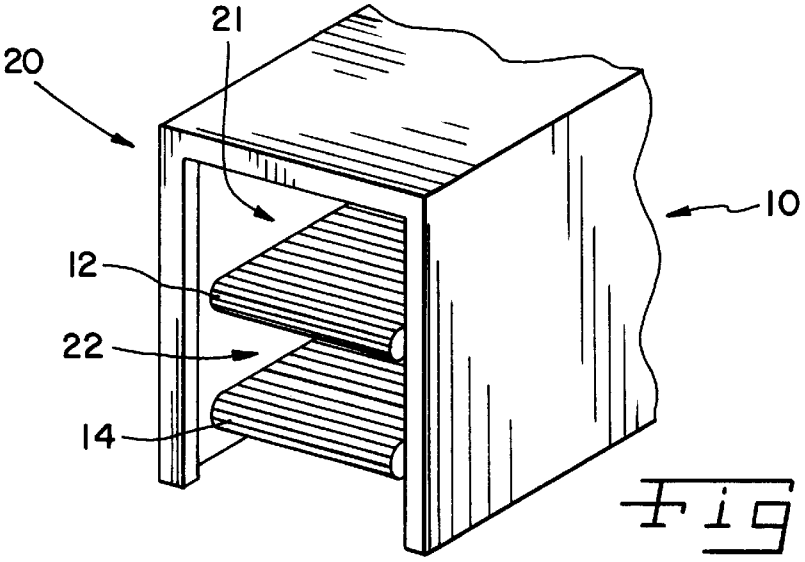
FIG. 2 is a perspective view of an opening of the aging oven of FIG. 1 with the door assembly removed.

Oven 10 includes a plurality of burners 16 utilized to heat the oven to the required heat treatment temperature, while along the top of oven 10 is a number of recirculating fans 18 that circulate air within oven 10 for even heat distribution. Oven 10 additionally includes openings 20 such as an entrance and exit through which parts to be heat-treated enter and exit oven 10. Each opening includes a top portion 21 and a bottom portion 22 (FIG. 2). Covering each entrance or exit opening 20 is a door assembly 24 as shown in FIGS. 3–6, to be discussed below.

Associated with oven 10 is a staging conveyor device 26 utilized in preparing groups of parts to be heat-treated and organizing and feeding them into position for either first rollers 12 or second rollers 14. At the beginning or entrance of staging conveyor device 26 is a means for electronic product differentiation, such as a load cell 28 (FIG. 4), which functions to weigh and determine the type of part to be heat treated arriving on a supply conveyor 30. Depending upon the programming of load cell 28 and the weight of the incoming workpiece (not shown), load cell 28 will place the workpiece either on the top surface 32 of the staging conveyor device 26 (as shown in phantom line in FIG. 1) preparing the workpiece for entry into oven 10 on first roller 12, or alternatively may place the workpiece on bottom conveyor 34 of staging conveyor device 26, thereby preparing the workpiece for entry onto second rollers 14. Other devices than a load cell 28 may equivalently be utilized to which product is placed on which conveyor or surface. Items entering staging conveyor 26 via supply conveyor 30 may include the workpiece itself, or possibly a workpiece disposed in a rack or frame for ease of handling. Additionally, wire-type baskets may be used to contain the workpieces. FIG. 2 shows an opening 20 of oven 10 with a first transport means, i.e., first rollers 12 oriented above second transport means, i.e., second rollers 14.

Door assembly 24, previously referred to, includes two rectangular doors, i.e., top door 36 and bottom door 38, to seal an opening 20 of oven 10. Top door 36 and bottom door 38 are substantially rectangular in shape and made from a heat resistant material to reduce heat escaping from oven 10. A lock/actuator assembly 40 is utilized to lock together top door 36 with bottom door 38. Lock actuator 40 permits selective separation of top door 36 from bottom door 38 during times when workpieces need to be moved into or out of oven 10. A drive mechanism 42 is connected to only top door 36. Drive mechanism 42 is adapted to lift either top door 36 or a combination of both top door 36 and bottom door 38.

Figure 4:
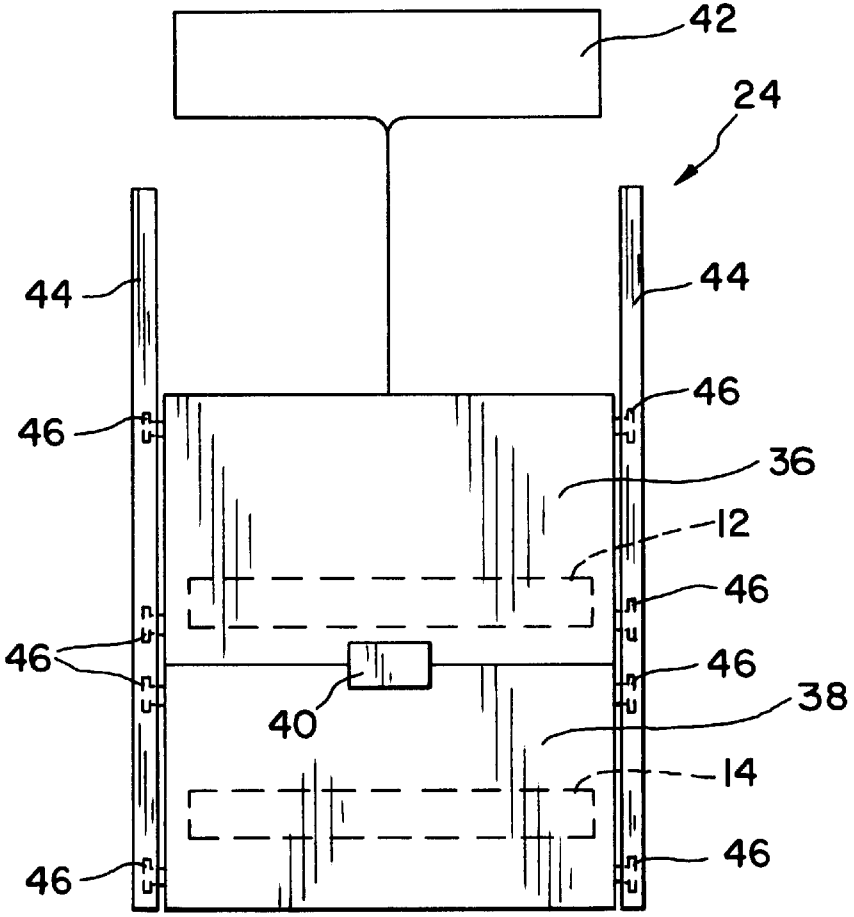
FIG. 4 is a diagramic view of an alternate embodiment of the door assembly of the present invention.
Figure 3:
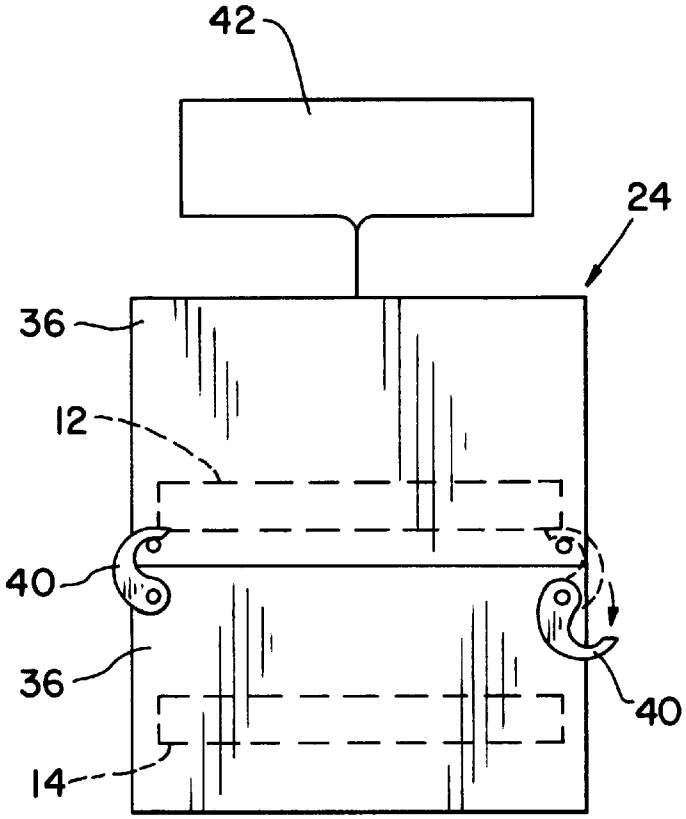
FIG. 3 is a front view of the door assembly in one form of the present invention.

As shown in FIG. 4, door assembly 24 includes two rails 44 along which doors 36 and 38 slide via either rollers or guide members 46. Guide members 46 attached to both doors 36 and 38 permit the doors to slide only in a vertical direction.

Figure 6:
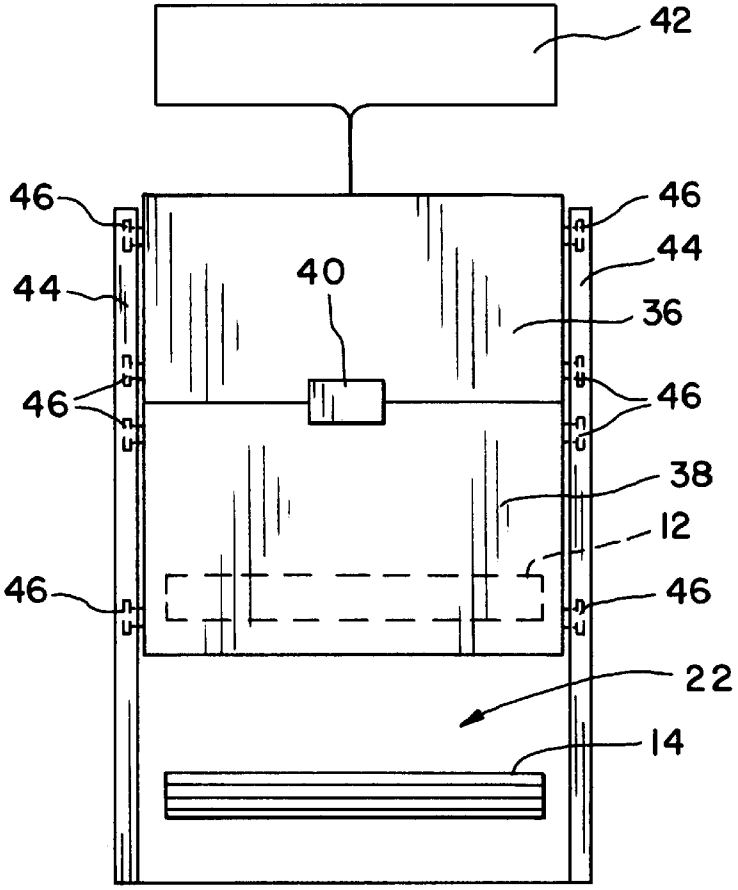
FIG. 6 is a diagramic view of the door assembly of FIG. 4 with the bottom portion of the oven opening open.
Figure 5:
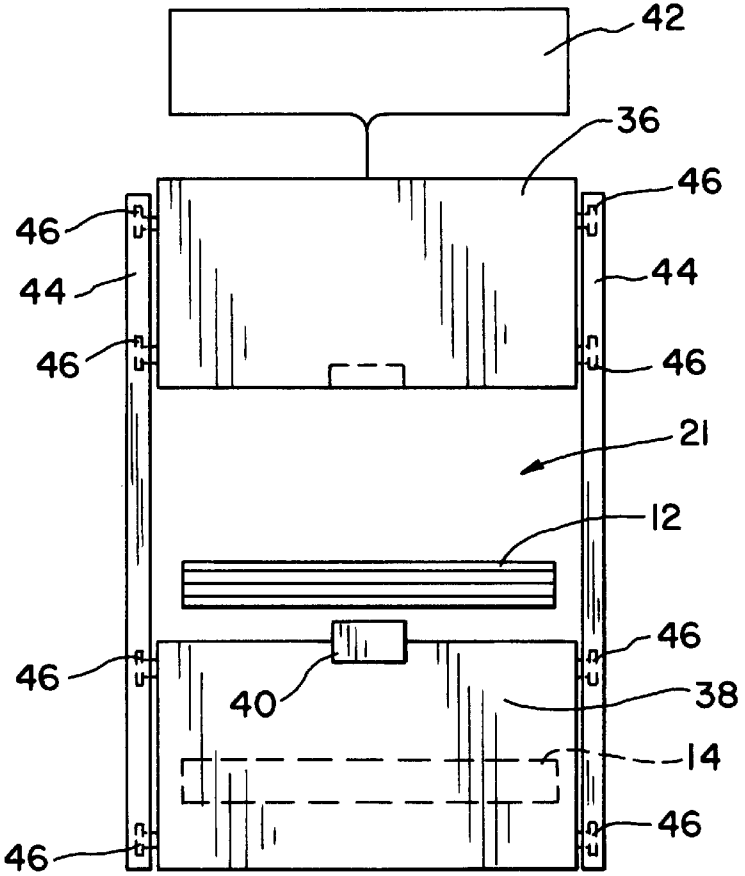
FIG. 5 is a diagramic view of the door assembly of FIG. 4 with the top portion of the oven open.

A feature of door assembly 24 is that heat loss is reduced from oven 10, since only half of the entire oven opening 20 needs to be open to access either first rollers 12 or second rollers 14. As shown in FIG. 5, for workpieces needing only access into oven 10 via rollers 12, door assembly 24 via drive mechanism 42 keeps top portion 21 open by lifting door 36, while adjacent bottom portion 22, over second rollers 14, is kept closed. Alternatively, as shown in FIG. 6, bottom portion 22 of oven opening 20 may be opened by activating lock actuator assembly 40 to connect together top door 36 and bottom door 38 and lifting assembly 24 by drive mechanism 42 to a position where bottom door 38 is oriented in the normally closed position of top door 36, while top door 36 is oriented above oven 10. If necessary to open both top and bottom portions 21, 22 of oven 10, drive mechanism 42 will continue to raise top door 36 and bottom door 38 to fully open both top and bottom portions 21, 22 of oven 10. Door assembly 24 thereby permits selective opening of top portion 21 and bottom portion 22 of oven opening 20.

In operation, a workpiece arrives via supply conveyor 30. Within or adjacent conveyor 30, load cell 28 determines which conveyor 32 or 34 of staging conveyor system 26 onto which the workpiece will be placed. A control unit (not shown) operates top conveyor 32 and bottom conveyor 36 at the proper speed for insertion of workpieces into oven 10. An electric sensor 50 associated with the end of each conveyor 32 or 34 senses when a part is approaching oven opening 20, thereby actuating door assembly 24 via drive mechanism 42 and lock actuator assembly 40 to open the proper portion (21, 22) of opening 20. A workpiece is then placed on to first rollers 12 or second rollers 14. As workpieces are placed on to first or second rollers 12 and 14, they will simultaneously move a previously inserted workpiece one further step into oven 10 to the point where they will be monitored via an electric sensor 52 which controls and operates door assembly 24 adjacent an exit oven opening 20. Depending on which level, i.e., roller rack, the workpiece is on, sensor 52 will operate either top door 36 or bottom door 38 to thereby only uncover the necessary section 21, 22 of oven opening 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heat treatment aging oven for heating metal parts, said oven comprising:

a heating chamber having an opening, whereby said heating chamber maintains substantially even heat distribution;

first transport means disposed within said heating chamber for moving a first metal part through said heating chamber;

second transport means disposed within said heating chamber for moving a second metal part through said heating chamber, said first transport means located in spaced relationship to said second transport means, said first transport means and said second transport means having two different heat treating process length times, whereby diverse product types may be heat treated within the same oven; and a door assembly adapted to cover said heating chamber opening, said door assembly comprising at least two doors arranged for vertical movement.

2. The aging oven of claim 1 in which said first transport means comprises a roller rack.

3. The aging oven of claim 1 in which said second transport means comprises a roller rack.

4. The aging oven of claim 1 in which said heating chamber opening includes a top portion and a bottom portion, said oven further having a door assembly adapted to cover said opening, said door assembly comprising:

a first door covering said top portion of said heating chamber opening;

a second door covering said bottom portion of said oven entrance;

a lock mechanism selectively locking said first door and said second door together; and a drive mechanism connected to one of said doors, said drive mechanism adapted to move said first door to open said top portion and adapted to move both said first door and said second door to open said bottom portion, whereby said top portion and said bottom portion of said heating chamber opening may be selectively and independently opened.

5. The aging oven of claim 4 further including a means for determining which said portion to open, said means controlling said lock mechanisms and said drive mechanism to open said determined portion.

6. The aging oven of claim 1 in which said first transport means is located above said second transport means.

7. A heat treatment aging oven for heating metal parts, said oven comprising:

a heating chamber having an opening, whereby said heating chamber maintains substantially even heat distribution;

first transport means disposed within said heating chamber for moving a first metal part through said heating chamber;

second transport means disposed within said heating chamber for moving a second metal part through said heating chamber, said first transport means located in spaced relationship to said second transport means, said first transport means and said second transport means having two different heat treating process length times, whereby diverse product types may be heat treated within the same oven;

a first door covering a first portion of the oven opening;

a second door covering a second portion of the oven opening;

a lock mechanism selectively locking said first door and said second door together; and a drive mechanism connected to said first door, said drive mechanism adapted to move said first door to open said first portion and adapted to move both said first door and said second door to open said second portion, whereby said first portion and said second portion of said heating chamber opening may be selectively and independently opened.

8. The aging oven of claim 7 further including means for determining which said portion to open, said means controlling said lock mechanism and said drive mechanism to move at least one of said doors to open said determined portion.

* * * * *